United States Patent [19]

Sorensen

[11] 4,291,830

[45] Sep. 29, 1981

[54] CONTAINER WITH LOCKING LID

[75] Inventor: James R. Sorensen, San Mateo County, Calif.

[73] Assignee: Georgia-Pacific Corporation, Portland, Oreg.

[21] Appl. No.: 106,741

[22] Filed: Dec. 26, 1979

[51] Int. Cl.[3] ..... B65D 5/32

[52] U.S. Cl. ..... 229/45 R; 229/23 R; 229/44 R; 229/DIG. 11

[58] Field of Search ..... 229/23, 44 R, 45, DIG. 11

[56] References Cited

U.S. PATENT DOCUMENTS

| | | | |
|---|---|---|---|
| 1,986,145 | 1/1935 | Goodyear | 229/45 |
| 2,220,122 | 11/1940 | Ringler | 229/34 |
| 2,551,814 | 5/1951 | Rushing et al. | 229/45 |
| 2,572,159 | 10/1951 | Kells et al. | 229/45 |
| 2,827,222 | 3/1958 | Buttery | 229/45 |
| 2,893,621 | 7/1959 | Harnish et al. | 229/DIG. 11 |
| 3,447,672 | 6/1969 | Bailey et al. | 229/45 X |
| 3,684,159 | 8/1972 | Wolfe | 229/45 |
| 3,692,231 | 9/1972 | Neitzke | 229/45 |
| 3,713,579 | 1/1973 | Chaffers | 229/44 R |
| 4,175,691 | 11/1979 | Cornell et al. | 229/23 R |

*Primary Examiner*—Davis T. Moorhead
*Attorney, Agent, or Firm*—Schuyler, Banner, Birch, McKie & Beckett

[57] ABSTRACT

A container with lid is disclosed having means for easily locking and unlocking the lid, and preventing unauthorized tampering with the locking mechanism. The locking mechanism comprises an apertured locking flap on the lid which is insertable into a locking recess in a wall of the container. The locking recess is confined by inner and outer wall portions. A locking tab extends from one of the wall portions into the locking slot to engage the aperture of the locking flap.

7 Claims, 7 Drawing Figures

FIG. 5
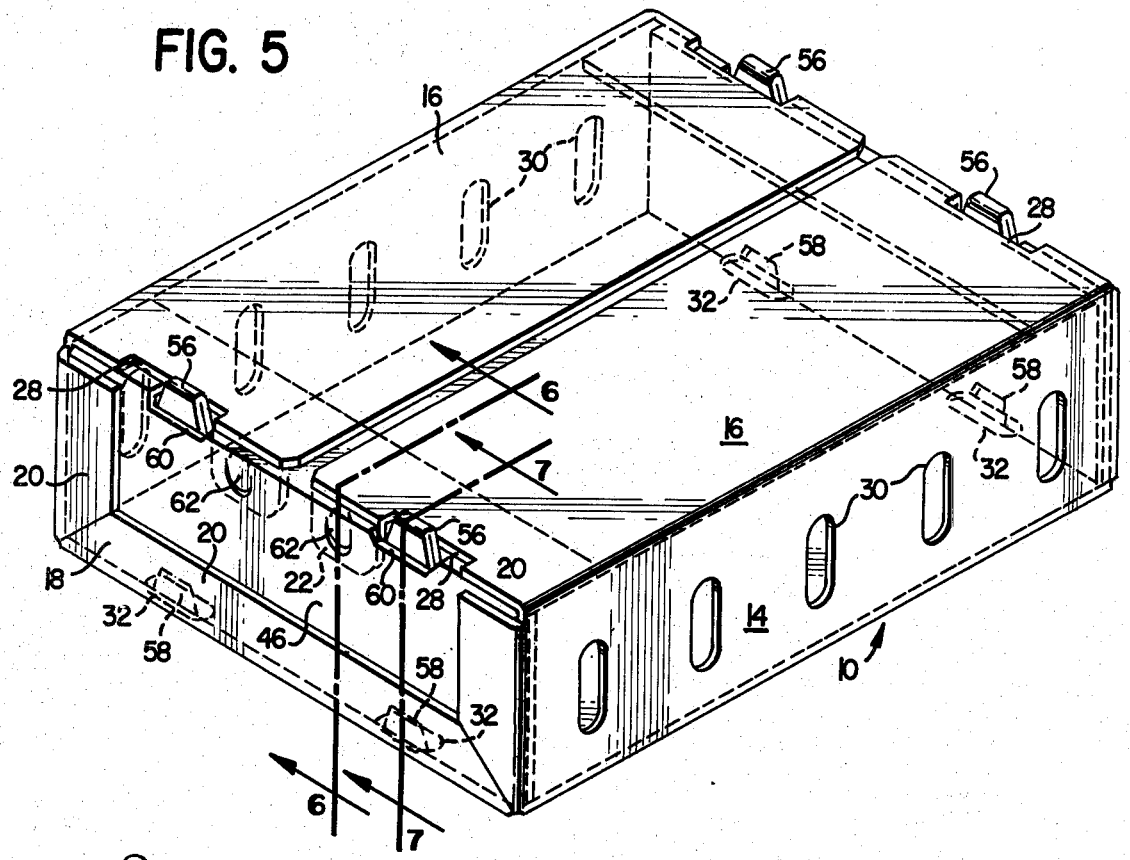
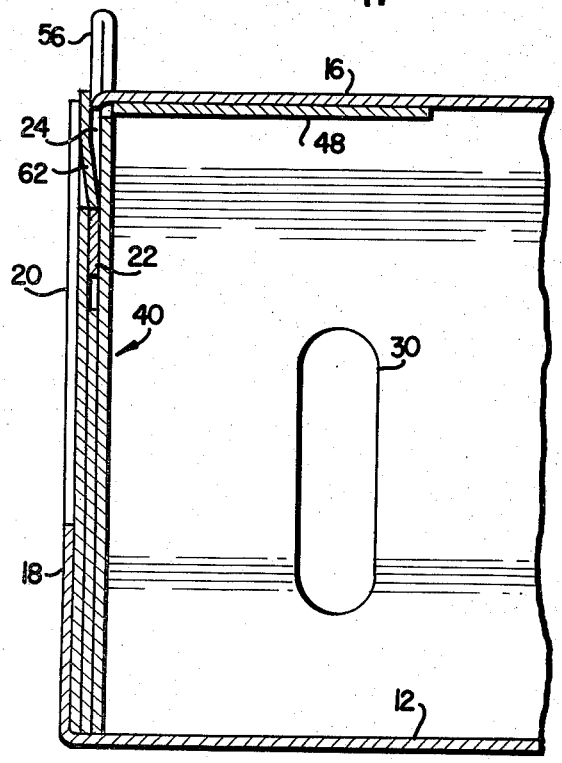
FIG. 6
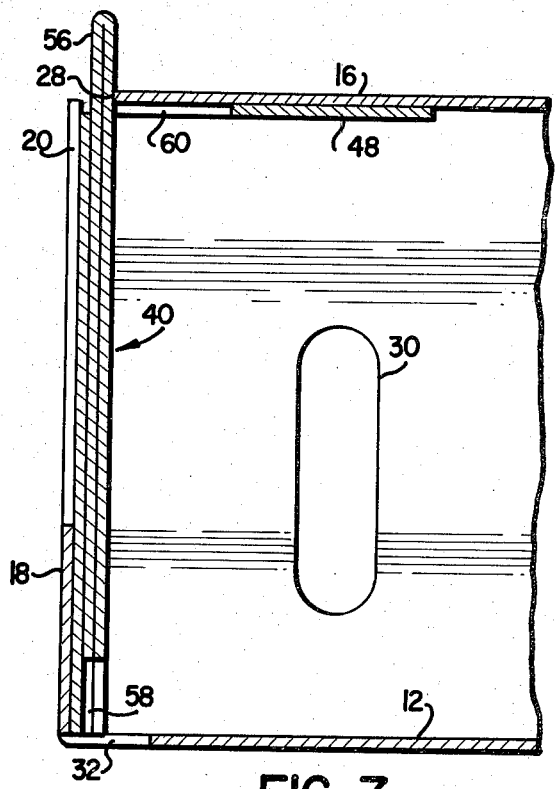
FIG. 7

CONTAINER WITH LOCKING LID

BACKGROUND OF THE INVENTION

1. Field of the Invention

The present invention relates to containers having reclosable covers and, more particularly, to containers having reclosable covers which may be locked in a closed position.

2. Description of the Prior Art

Fruits and vegetables are often shipped in paperboard cartons having reclosable lids. One type of carton used for this purpose comprises a separate container body and slip cover, such as that disclosed in Rushing U.S. Pat. No. 2,551,814. Another type of container, such as that disclosed in Chaffers U.S. Pat. No. 3,713,579, includes a lockable lid which is hinged to the container body.

The container disclosed in the Chaffers patent is a stackable container, having upstanding stacking tabs projecting above the container lid, and stacking recesses formed in the container bottom for receiving the stacking tabs of a subjacent container. The locking mechanisms for the lid portions of this container are incorporated in the stacking tab structure. Specifically, a relief formed on side of each stacking tab is adapted to receive a mating upwardly extending locking tab carried by the lid. Such an arrangement would appear to possess a number of disadvantages. For example, it would appear to be quite difficult to pry back the locking tabs from the relief areas of the stacking tabs to permit the lid to be opened. In addition, because of the integration of the locking means with the tab structure, the locking means would appear to be vulnerable to damage in the event of rough handling of the container. Damage to the locking tabs or stacking tabs would prevent repeated secure locking of the lid. In addition, the clearly visible locking means could easily be circumvented by unauthorized persons intent on pilferage of the contents of the container.

SUMMARY OF THE INVENTION

Accordingly, it is an object of the present invention to obviate the above noted shortcomings of the prior art by providing a container having a reclosable locking lid which will discourage or substantially prevent unauthorized opening of the lid by persons unfamiliar therewith, but permit the lid to be easily unlocked and opened by those familiar with the locking mechanism.

Another object of the invention is to provide such a container wherein the lid is repeatedly reclosable and lockable without appreciable loss of locking capability.

Another object of the invention is to provide such a container wherein the locking mechanism is substantially totally protected from damage due to rough handling of the container.

Another object of the invention is to provide such a container which is stackable with others of the same type, but does not rely upon the stacking structure for secure locking of the lid in a closed position.

These and other object of the invention are accomplished by providing a container having a body, a lid, the body defined at least in part by a wall, a locking slot extending into the wall from an edge of the wall, the wall having inner and outer wall portions confining the slot, a locking flap carried by the lid and having a relief therein, the flap extendable into the slot when the lid is closed to position the relief between the inner and outer wall portions, and a locking tab carried by one of the wall portions and extendable into the slot to engage the relief when the lid is closed to lock the lid to the body.

BRIEF DESCRIPTION OF THE DRAWINGS

The novel features of the invention are set out with particularity in the appended claims, but the invention would be understood more fully and clearly from the following detailed description of the invention as set forth in the accompanying drawings in which:

FIG. 5 is a perspective view of the container showing the lid portions in their closed and locked positions;

FIG. 6 is a partial sectional view of the container taken along line 6—6 of FIG. 5; and FIG. 7 is a partial sectional view of the same taken along line 7—7 of FIG. 5.

DESCRIPTION OF THE INVENTION

In the preferred embodiment of the invention described below and shown in the figures, the container is described as constructed of corrugated paperboard, and used for transporting fruit and vegetables. It is to be understood, however, that the container may be fabricated of other suitable material, and may be used for the shipment or storage of any objects or materials.

Figure 1:
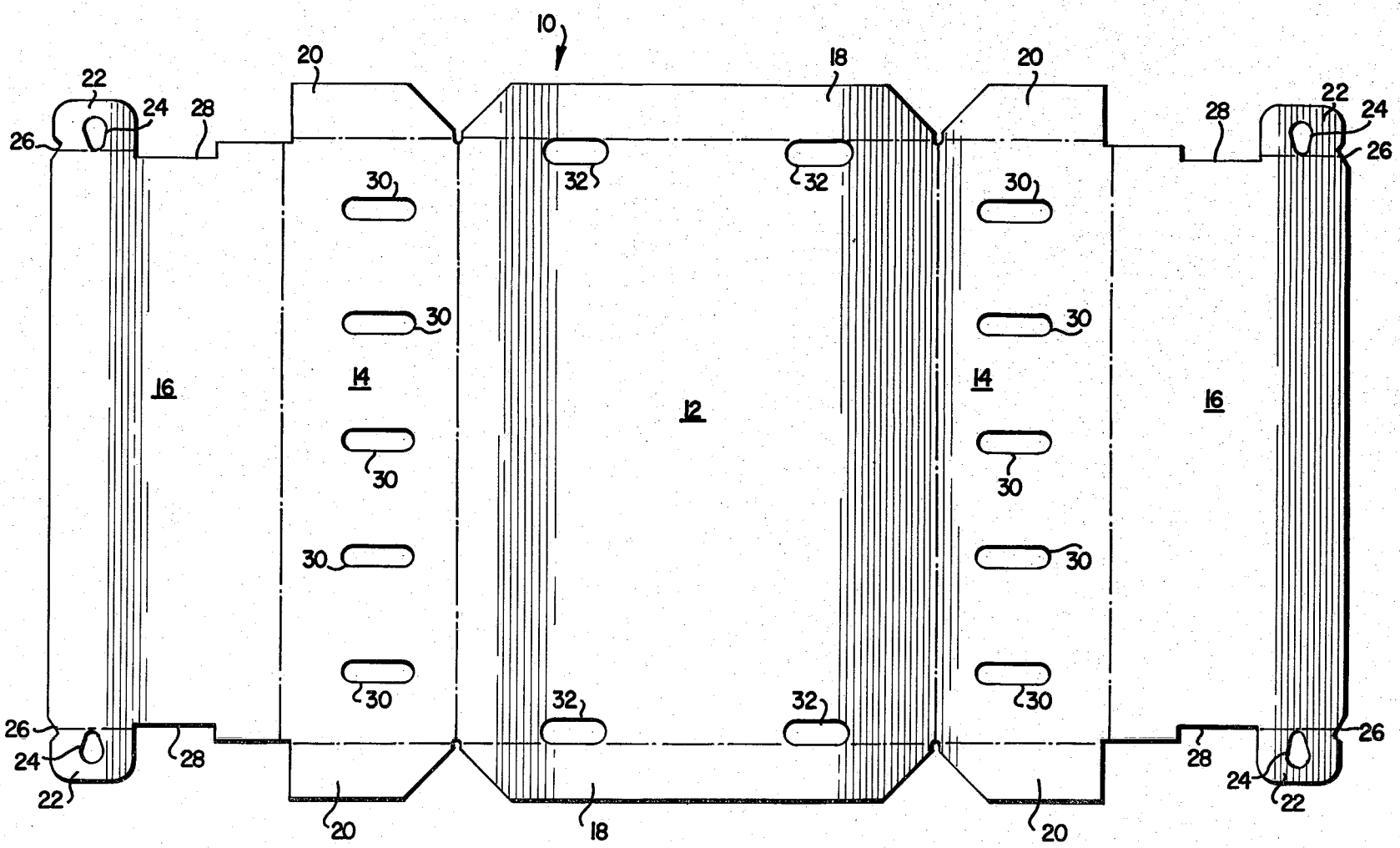
FIG. 1 is a plan view of a foldable container blank prior to folding and assembly.
Figure 2:
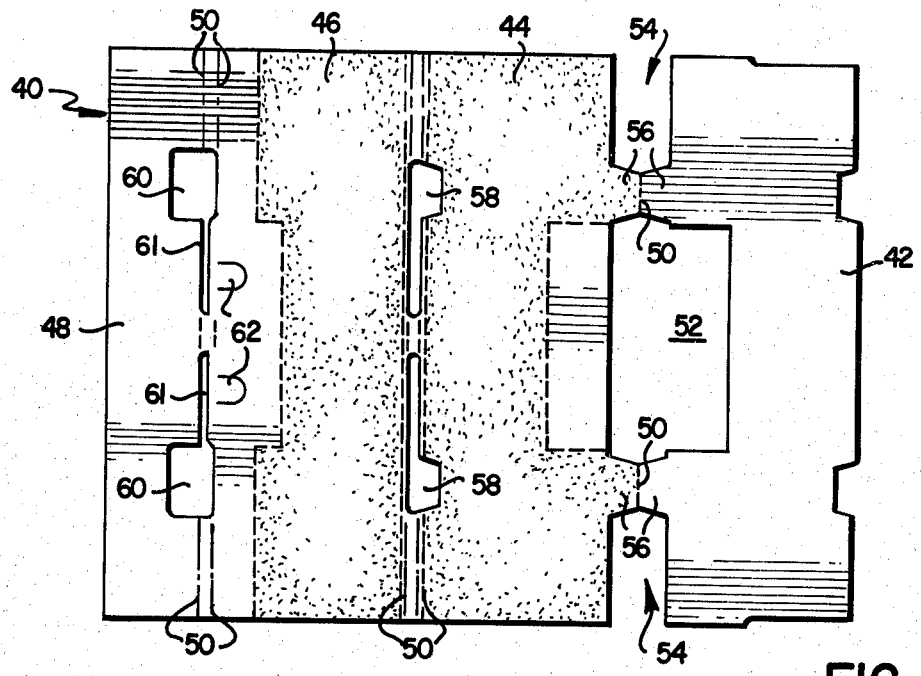
FIG. 2 is a plan view of an end wall blank of the container prior to folding and assembly.
Figure 3:
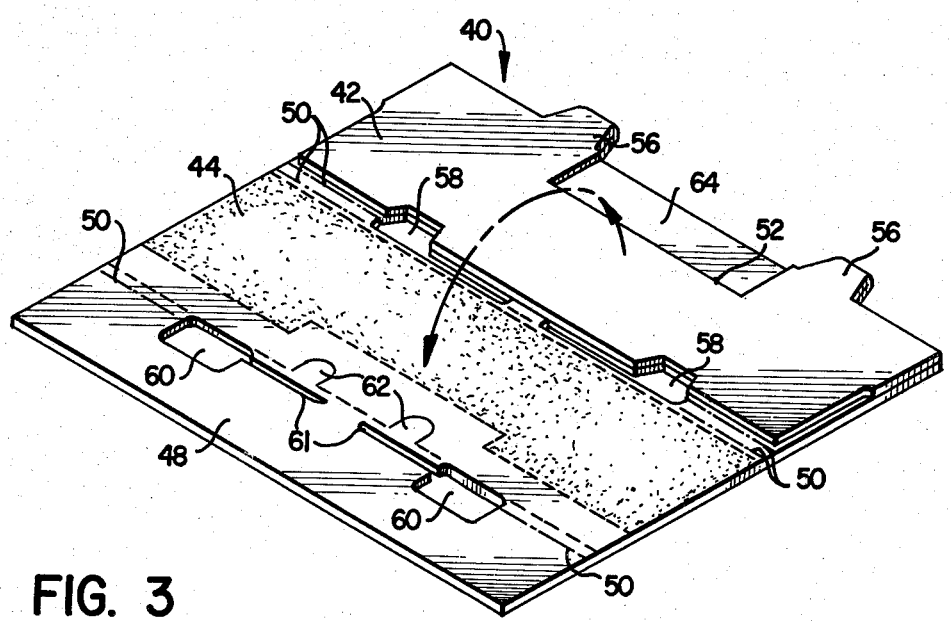
FIG. 3 is a perspective view of the end wall blank of FIG. 2 in a partially folded configuration.

FIG. 1 illustrates a foldable cardboard blank in its unfolded configuration for forming the sides, bottom and lids of the container. FIGS. 2 and 3 illustrate an end wall blank for the container. Two of the end wall blanks, when folded, are joined to a single blank of FIG. 1 to form a container according to the invention.

Referring to FIG. 1, container blank 10 comprises a bottom 12, sidewalls 14, and lid portions 16 joined to the sidewalls. The opposite ends of bottom panel 12 comprise end wall tabs 18. End wall tabs 20 are provided on the opposite ends of sidewalls 14. The corners of lid portions 16 are provided with locking flaps 22. Each locking flap 22 has a locking relief in the form of an aperture 24 formed therein. One edge of each locking flap 22 is provided with a retaining notch 26. Clearance notches 28 are also provided on the opposite ends of lid portions 16. Ventilation holes or slots 30 are provided in sidewalls 14. Four clearance holes 32 are provided at the opposite ends of bottom panel 12. The functions of the above mentioned elements are described in detail below. The dot-dash lines appearing in FIG. 1 represent score or fold lines along which the separate panels are folded relative to one another to form the container body.

Referring to FIGS. 2 and 3, end wall blank 40 comprises a center panel 42, an inner panel 44, an outer panel 46 and a ledge flap 48. Each of these panels and flap are foldable relative to one another along fold or score lines 50. Center panel 42 is formed with a central cutout 52 and side cutouts 54 so that it remains connected to inner panel 44 solely by tabs 56. When folded together as shown in FIG. 3, these tabs overlie one another to form stacking tabs for the container. Center panel 42 and inner panel 44 also have notches 58 which overlie one another when folded to form stacking recesses for the container. Cutouts 60 formed in ledge flap 48 provide clearance space for the passage of stacking tabs 56 when the container is assembled, as well as clearance through the narrow slot portions 61 of cutouts 60 for locking flaps 22 of lid portions 16. This relationship is described more fully below. Outer panel 46 is provided with a pair of locking tabs 62. These are formed by two U-shaped cuts through outer panel 46. The stippled areas shown in FIGS. 2 and 3 represent surfaces to which adhesive will be applied prior to folding blank 40 into its assembled configuration. When so assembled, center panel 42 would be sandwiched between inner panel 44 and outer panel 46, with cutoff 52 defining a locking slot 64 which receives locking flaps 22 of lid portions 16 when the lid portions are closed.

Figure 4:
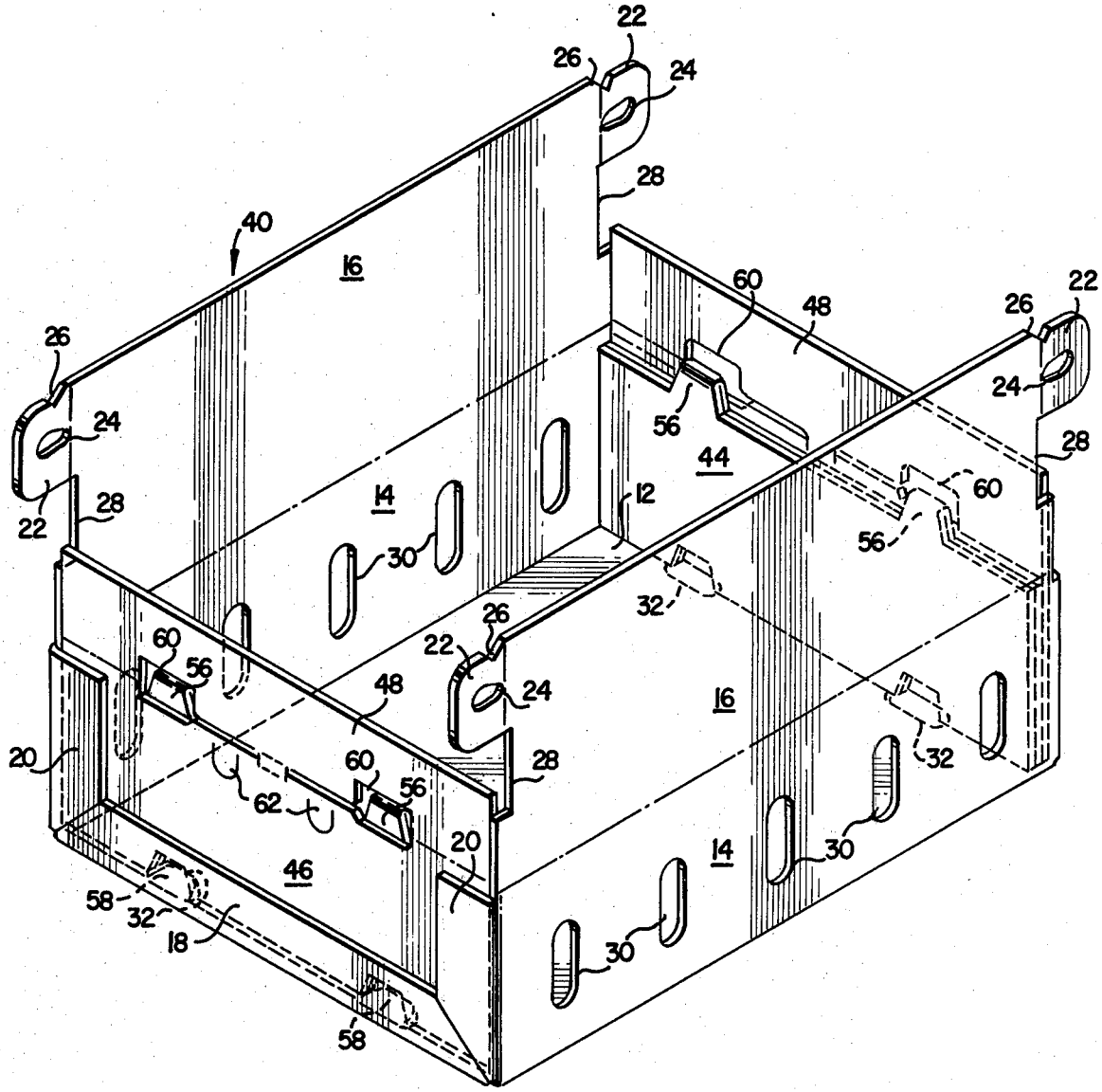
FIG. 4 is a perspective view of the assembled container showing the lid portions in an open position.

Referring to FIG. 4, two end wall blanks 40 are glued and folded to form completed end walls, and are then glued in position to container blank 10 along the mating surfaces of end wall tabs 18 and 20. When the glue has set, the container is completed and is ready to be filled, closed and locked. Ledge flaps 48 are folded inward along the top edges of end walls 40. Cutouts 60 in ledge flaps 48 clear stacking tabs 56 when they are folded over, and the narrow slot portion 61 provides clearance for the insertion of locking flaps 22. Lid portions 16 are then folded over, and locking flaps 22 are inserted through narrow slots 61 into locking slots 64 between inner panel 44 and outer panel 46. When locking flaps 22 are fully inserted into locking slots 64, apertures 24 are in alignment with locking tabs 62. Locking tabs 62 are then pressed inward into engagement with apertures 24 to lock lid portion 16 into position. Notches 28 on the opposite ends of lid portions 16 clear stacking tabs 56 as the lid portions are closed. Retaining notches 26 of lid portions 16 engage the ends of narrow slots 61 to provide detent type retaining assistance to the locking mechanism.

It can readily be seen that the locking mechanism employed in the container according to the invention is substantially completely protected from damage due to rough handling owing to its substantially concealed design. Locking tabs 62 cannot be easily pried outwardly to unlock lid portions 16. However, unlocking can be easily accomplished by the mere insertion of a slender tool into narrow slots 61 between locking flap 22 and outer panel 46. Such a tool would ride past locking tab 62 and force it outwardly flush against the inner surface of outer panel 46, thereby freeing aperture 24. Locking flap 22 can then be easily withdrawn from locking slot 64. Such an unlocking method imparts virtually no detrimental wear or deformation to locking tab 62, so that secure locking of the lid portions 16 can be repeatedly accomplished. A plurality of these containers can be stacked merely by placing one on top of the other with stacking tabs 56 in an engagement with stacking recesses 58 of superposed containers. The locking mechanism of the container will be unaffected by any damage that might occur to stacking tabs 56. It will be obvious to one of ordinary skill that numerous modifications may be made without departing from the true spirit and scope of the invention which is to be limited only by the appended claims.

What is claimed is:

1. In a container having a body and a lid, said body defined at least in part by a wall, the improvement comprising:

a locking slot extending into said wall from an edge of said wall, said wall having inner and outer wall portions confining said slot;

a locking flap carried by said lid and having a locking relief therein, said flap extendable into said slot when said lid is closed to position said locking relief between said inner and outer wall portions; and a locking tab carried by said outer wall portion and extendable into said slot to engage said locking relief when said lid is closed to lock said lid to said body.

2. A container according to claim 1 wherein said locking tab is extendable downwardly and inwardly into said slot to engage said locking relief.

3. A container according to claim 2 wherein said lid is hinged to said body, and locking flap is hinged to said lid, and said locking tab may be released from said locking relief by inserting a slender tool between said locking flap and said outer wall portion to press said locking tab out of said locking relief.

4. A stackable container according to claim 1 further comprising at least one stacking tab extending above said lid and at least one stacking recess in the bottom of said body for receiving a stacking tab of a subjacent container, said stacking tab and stacking recess being separate and distinct from said locking flap and slot.

5. A container according to claim 1 wherein said wall comprises three panels in face-to-face abutting relation, said center panel having a notch along said edge of said wall which defines said slot.

6. A stackable container according to claim 5 wherein said wall comprises at least one stacking tab extending above said edge and at least one relief along the opposite edge of said wall defining a stacking recess for receiving a stacking tab of a subjacent container.

7. A container comprising:

a body;

a lid hinged to said body;

a wall defining at least a portion of said body, said wall comprising three panels in face-to-face abutting relation;

a locking slot extending into said wall from an edge of said wall, said slot defined by a notch in the center one of said three panels along said edge; p1 a locking flap hinged to said lid and having a locking relief therein, said flap extendable into said slot when said lid is closed to position said locking relief between the inner and outer panels of said wall; and a locking tab carried by said outer panel and extendable downwardly into said slot and inwardly toward said inner panel to engage said locking relief when said lid is closed to lock said lid to said body.

* * * * *